United States Patent [19]

DeCoursey

[11] 4,008,724

[45] Feb. 22, 1977

[54] METHOD AND APPARATUS FOR TREATING TOBACCO

[76] Inventor: Leonard T. DeCoursey, R.R. No. 3, Hardinsburg, Ky. 40143

[22] Filed: Nov. 18, 1975

[21] Appl. No.: 633,164

Related U.S. Application Data

[62] Division of Ser. No. 426,112, Dec. 19, 1973, Pat. No. 3,931,825.

[52] U.S. Cl. ..... 131/133 A

[51] Int. Cl.[2] ..... A24B 3/12

[58] Field of Search ..... 131/131, 133, 133 A, 131/134, 135, 136, 137, 140

[56] References Cited

UNITED STATES PATENTS

| | | | |
|---|---|---|---|
| 2,832,353 | 4/1958 | Doyle | 131/133 A |
| 3,372,703 | 3/1968 | Conard | 131/133 R |

FOREIGN PATENTS OR APPLICATIONS

| | | | |
|---|---|---|---|
| 702,253 | 1/1965 | Canada | 131/133 A |
| 521,224 | 5/1940 | United Kingdom | 131/133 A |

*Primary Examiner*—Robert W. Michell
*Assistant Examiner*—V. Millin

[57] ABSTRACT

An apparatus for moistening tobacco in which the non-condensibles in a mass of dry, compressed tobacco are substantially entirely eliminated by subjection to a very low absolute pressure, preferably below 1 in. Hg, followed by a first steaming to a pre-determined temperature under the influence of a maximum pressure differential, holding, re-evacuation, during which a loosening occurs, and a final steaming.

3 Claims, 2 Drawing Figures

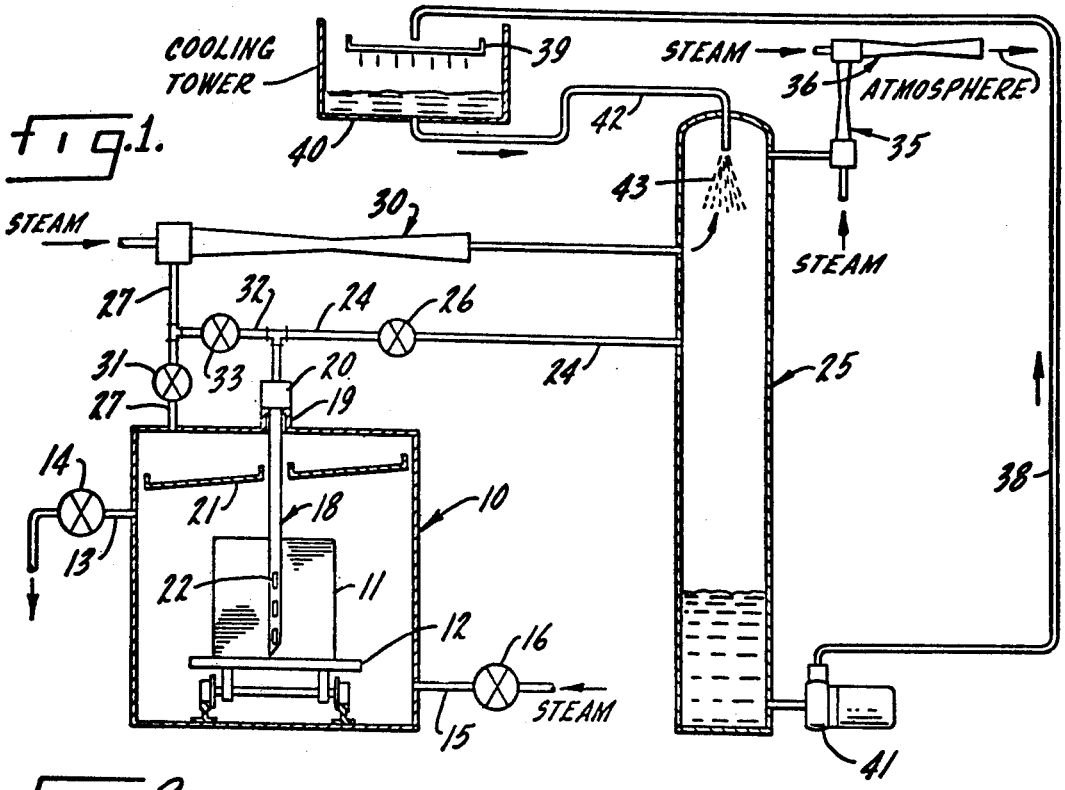
fig. 1.
fig. 2.
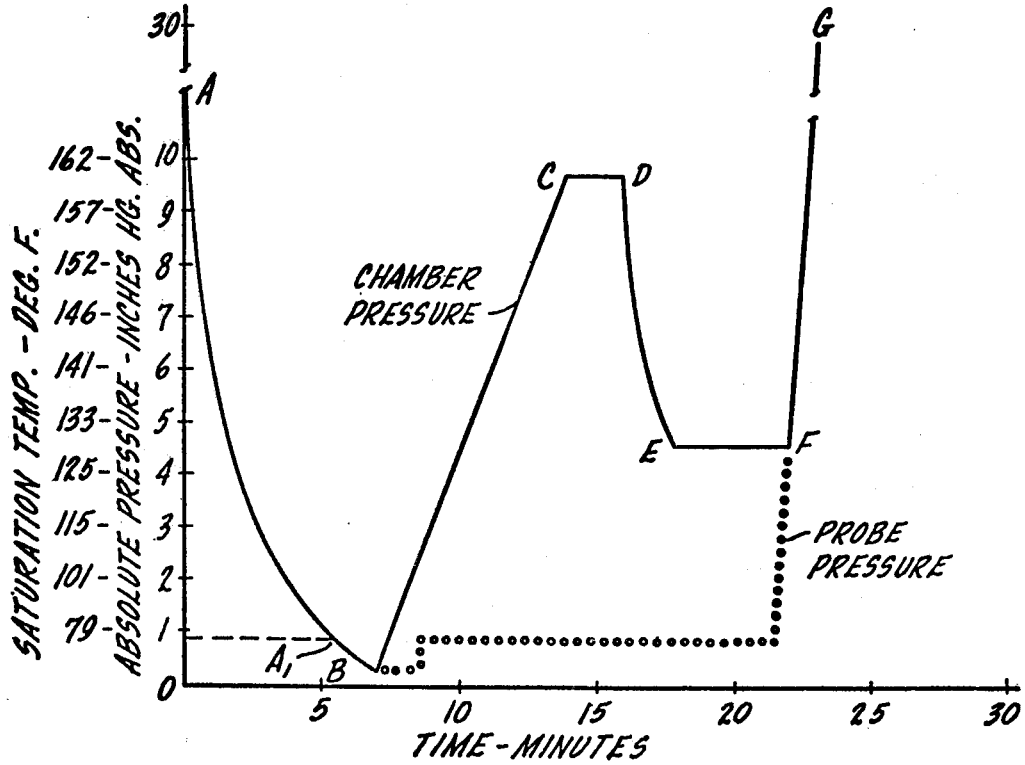

METHOD AND APPARATUS FOR TREATING TOBACCO

This is a division, of application Ser. No. 426,112, filed Dec. 19, 1973 now U.S. Pat. No. 3,931,825.

This invention relates to an apparatus for quickly and efficiently conditioning tobacco which has been stored in bales, boxes, hogsheads, or other containers in a compressed condition. Tobacco which has been so packed and stored is invariably too stiff and dry to be further processed without excessive and unacceptable loss of product.

Prior methods of conditioning tobacco have one or more disadvantages which have prevented their universal acceptance by the trade. The following are given by way of example.

In the sweat room method of moistening tobacco the tobacco is stored for several weeks under air conditioning of about 90° F and 90% relative humidity. The disadvantages of this method include the large space requirement and the uneveness of moistening, since generally a high moisture gain is experienced on the outside of the tobacco and almost no gain on the inside.

In the high vacuum process tobacco is placed into a strong chamber which is completely sealed. The air is evacuated from the chamber and the tobacco, and when a very low absolute pressure is reached a mixture of steam and water is introduced into the chamber. This mixture penetrates the compressed tobacco adding warmth and moisture to it. The cycle is repeated several times until the desired degree of moistening is obtained at which time the chamber is vented to atmosphere and the tobacco removed. The primary disadvantage of this method is the great length of time required since the steaming and soaking part of the cycle may be less than half the full cycle time.

In the steam conditioning method perforated tubes connected to a steam line under a pressure of about 20 psi are inserted into a mass of tobacco and steam under pressure is forced through the tobacco in a radially outward direction. A disadvantage of this method is that the temperature of the steam must be above 212° F for it is not possible to have steam at less than this temperature at atmospheric pressures. Therefore, moistening tobacco by this method requires raising the temperature of at least some of the tobacco to 230° F which is considered highly objectionable by most tobacco manufacturers. Furthermore it is impossible to obtain exactly the desired moisture gain throughout the product, since uniform conditioning can only be obtained by allowing all the tobacco to reach the same temperature.

In the circulating air process tobacco to be moistened is placed inside a vented air-tight chamber and a perforated tube inserted in the body of tobacco. The tube is connected to the intake side of a fan, and the air in the chamber is connected to the discharge side of the fan. The slight suction created by the fan causes air from the chamber to flow radially through the tobacco into the perforated tube, where it passes through the conditioning mechanism in which warmth and humidity are added to restore the air to the correct chamber conditions, and the air is re-circulated. A substantial disadvantage of this method is the great length of time required and the fact that steam penetration of the individual leaves is not especially efficient, since there is no removal of non-condensibles from the tobacco leaves prior to or at any time during contact with the moisture laden air blown into the chamber.

In the Vacuum Flow process, which to date has come closest to universal acceptance, a perforated probe is inserted into a mass of tobacco to be moistened, a vacuum drawn on the probe in chamber until an absolute pressure in the range of 2 – 3 inches of Hg absolute is reached, steam is admitted to the chamber while the probe is connected to vacuum, the pressure is permitted to rise to about 6 inches Hg and maintained at that level for a period of time prior to breaking vacuum.

However, even this process has some drawbacks since it represents, in some respects, a compromise between conflicting factors.

Thus, for example, the pressure differential over which the steaming occurs has been rather modest, due, in part at least, to the need to break vacuum at a tobacco temperature which is non-deleterious to the tobacco and suitable for further processing. Further, non-condensibles in the tobacco are not as completely removed as is often desired before steam penetration begins, and the driving force of the steam may not be as powerful as desired.

SUMMARY OF THE INVENTION

In the present invention the tobacco to be moistened is placed in a vacuum chamber and an evacuation probe is inserted into the mass of dried tobacco. Preferably the probe and chamber are connected by suitable valving to a first stage steam ejector which discharges into a condenser, the condenser in turn discharging into additional steam ejector means, such as sequentially arranged second stage and third stage steam ejectors, often referred to as a "piggy-back" ejector system.

In operation, evacuation to an absolute pressure below the flash point, and preferably to a level of less than 1 inch Hg absolute, is carried out to remove all, or nearly all, of the non-condensibles and thoroughly condition the tobacco for subsequent steaming. This is followed by simultaneous admission of steam into the chamber and evacuation through the probe which results in a radially inward flow of steam and a gradual pressure rise from the exceedingly low starting absolute pressure. The pressure rise is followed by a pressure holding period at a pressure corresponding to a predetermined maximum temperature which may, for example, be a temperature which will ensure total bug kill. Thereafter the tobacco is re-evacuated and a second steaming operation, preferably at a temperature lower than the first steaming operation, is carried out to conclude the process.

Accordingly, it will be seen that the primary object of the invention is to provide an apparatus for quickly and efficiently moistening stored tobacco whereby it may be suitably conditioned for further processing.

A further object is to condition stored tobacco by a process in which only a near irreducible minimum of non-condensibles are present in the tobacco prior to subjection to steaming, whereby the effectiveness of steam penetration into each piece of tobacco is maximized.

Another object is to provide an apparatus of moistening tobacco in which a near maximum pressure differential is provided between the initial entering steaming temperature and the maximum steaming temperature so that maximum conditioning is obtained from the initial steaming operation, and the tobacco, after a subsequent evacuation, has been extremely effectively pre-conditioned for a subsequent steaming operation.

Another object is to provide an apparatus in which loosening of the tobacco is maximized, this loosening resulting in an increase in volume of the tobacco which facilitates subsequent handling.

Another object is to provide an apparatus for moistening tobacco in which cold spots are virtually eliminated. This latter advantage is coming into increasing prominence with the change in tobacco processing methods from laid leaf to intermixed; with intermixed tobacco cold spots which remain after conditioning are particularly disruptive of the subsequent tobacco manufacturing process.

Other objects and advantages of the invention will be apparent from an understanding of a drawing and subsequent description.

DESCRIPTION OF DRAWING

The invention is illustrated more or less diagrammatically in the accompanying figures wherein:

FIG. 1 is a schematic diagram of one embodiment of an apparatus suitable for practicing the present invention; and FIG. 2 is a cycle diagram illustrating a typical cycle of the present invention.

Referring first to FIG. 1 a vacuum chamber is indicated generally at 10. A quantity of tobacco which may, for example, be a hogshead of tobacco from which the cover has been removed and the side slats removed or loosened, is indicated at 11 resting on a moveable dolly or platform 12. For convenience the platform may be rail mounted for ease of admission and removal of the tobacco from the chamber. It will be understood that the capacity of the chamber may be varied within wide limits in that chambers may be of a size sufficient to handle anywhere from one small box of tobacco to six, eight or even a larger number of hogsheads.

An atmosphere venting conduit is indicated at 13, the conduit having a vacuum break valve 14, preferably of the butterfly type, therein. A chamber steam admission line is indicated at 15 and a chamber steaming valve at 16. It will be understood that a hinged or vertically rising door may be provided at one or both ends of the chamber for moving tobacco into and out of the chamber, the door having appropriate vacuum tight seal means, the provision of which is within the skill of the art.

An evacuation probe is indicated generally at 18, the probe passing through suitable vacuum tight sealing means indicated at 19 in the cover or top of the vacuum chamber. Suitable mechanism for moving the probe between a retracted position, in which it is elevated and out of contact with the tobacco in the chamber, and an extended position in which it has been inserted into the central zone of a mass of tobacco is indicated at 20. The probe passes through a false ceiling 21 in the vacuum chamber, the purpose of which is to intercept condensation which forms on the roof of the chamber and deflect it away from the tobacco being conditioned.

The probe includes a calculated number of orifices, which may be circular or elongated holes, indicated generally at 22, and is preferably of a length sufficient to extend completely to the bottom of the mass of tobacco in the extended position as shown. It will be noted that the probe terminates about ½ to 1 inch above the bottom of the tobacco, and no probe holes are present in the upper portion of the probe above the top of the mass of tobacco to be conditioned.

An exterior extension of the probe is connected to a first vacuum conduit 24, the conduit discharging into a condenser 25. A condenser isolating valve is indicated at 26 in the first vacuum conduit.

A second vacuum conduit is indicated at 27, said second vacuum conduit having its intake end opening directly into the chamber. Said second vacuum conduit connects to condenser 25 and a first stage steam ejector indicated generally at 30. A chamber isolating valve is indicated at 31.

A third vacuum conduit is indicated at 32, said third vacuum conduit having one end in communication with the first vacuum conduit 24 between the probe and the condenser isolating valve 26, and the other end opening into the second vacuum conduit 27 between the chamber isolating valve 31 and the first stage steam ejector 30. A probe isolation valve 33 is located in the third vacuum conduit.

The evacuation system further includes second evacuation means which, in this instance, consists of a second stage steam ejector 35 and a third stage steam ejector 36, the second stage steam ejector discharging directly into the third stage ejector and having its intake opening into condenser 25. The third stage steam ejector discharges to atmosphere. It will thus be seen that the first stage runs condensing, and the second and third stages, often called piggy-back ejectors, run non-condensing.

The condensation system includes, in addition to the condenser chamber, a discharge line whose intake is beneath the water level in the condenser, and whose outlet discharges into a suitable water dispersion mechanism 39 in cooling tower 40. A suitable pump means is indicated at 41. Cooled water from cooling tower 40 is transferred by line 42 into the condenser chamber where it is admitted in a finely divided spray 43 positioned in the fluid path between the openings of vacuum conduits 24 and 27 on the one hand, and the inlet to second stage ejector 35 on the other hand. Arrows in lines 38 and 42 indicate the direction of flow of the cooling fluid.

The use and operation of the invention are as follows.

In operation, tobacco in a compressed condition and which is too dry and brittle for entry into the tobacco manufacturing process is placed on wheeled dolly 12 and rolled into vacuum chamber 10, the probe 18 being retracted by mechanism 20 to permit entry of the tobacco. Once in position the door is closed, the chamber sealed, and the mechanism 20 operated to extend the probe 18 downwardly to the illustrated FIG. 1 position. The probe is located in the central zone, and preferably along the vertical central axis, of the mass of tobacco 11 to be moistened. Once the probe is in position in which it extends substantially the full vertical height of the mass of tobacco with all perforations 22 opening only into the mass of tobacco 11 the steam ejector system is operated to create a vacuum within the chamber and within the mass of tobacco. The cycle will become clear from a reference at this point to FIG. 2 and the following Valve Diagram.

VALVE DIAGRAM

| Step | Point In Cycle | Chamber Steaming Valve 16 | Chamber Isolation Valve 31 | Probe Isolation Valve 33 | Condensor Isolation Valve 26 | Break Vacuum Valve 14 |
|---|---|---|---|---|---|---|
| Initial Evacuation | A | C | O | O | O | C |
| Flash Point | $A_1$ | C | O | O | C | C |
| Pull Down Point | B | O | C | O | C | C |
| 2nd Stage Jet Take Over | $B_1$ | O | C | C | O | C |
| First Holding | C | O (throttling) | C | C | O | C |
| Re-evacuation | D | C | O (controlled) | O | O | C |
| Second Holding | E | O (throttling) | C | C | O | C |
| Break-Out | F | C | C | C | C | O |
| Removal/Initial Evacuation | G | C | O | O | O | C |

Refering now to FIG. 2, which is a typical cycle diagram described in terms of absolute pressure and corresponding saturation temperature along the vertical axis, and time along the horizontal axis, the following operations occur.

INITIAL EVACUATION

At zero minutes evacuation of the chamber through vacuum conduits 24 and 27 by means of the second and third stage steam ejectors 35 and 36 begins.

In this condition the vacuum break valve 14 and chamber steaming valve 16 are closed, the vacuum break valve remaining closed until the very end of the cycle.

Chamber isolation valve 31, probe isolation valve 33 and condenser isolation valve 26 are open. Rapid evacuation of the chamber and the tobacco occurs, as will be noted from the steep slope of that portion of the curve which begins at point A and extends toward point B.

It will be understood that at point A the chamber temperature is ambient and the tobacco temperature may be any temperature within a range of, for example, 33° to 95° F depending upon the temperature of the storage location of the tobacco prior to placement in vacuum chamber 10 for moistening.

It should also be understood that in a typical installation the second and third stage steam ejectors are effective down to an absolute pressure of about 1 inch Hg absolute, and a first stage steam ejector may be effective in the range of from about 2 – 3 inch Hg absolute down to about 0.2 inches Hg absolute.

Accordingly, shortly before the lower effective limit of the second and third stage ejectors is reached and, concurrently, after the effective working range of the first stage ejector is reached, the first stage ejector is brought on stream. Thus, for example, the first stage jet 30 may be cut in when the absolute pressure in the chamber reaches about 2 in. Hg.

At the cut in point of the first stage jet 30 the condenser isolating valve 26 is closed.

FLASH POINT

At some point near the end of the first evacuation, step A–B, a condition will be attained in which the chamber temperature and the tobacco temperature are identical, which condition is hereafter referred to as the flash point. For purposes of illustration the flash point is indicated at point $A_1$ in FIG. 2 although it will be understood it may vary widely; indeed, it may occur at any point in the first evacuation period corresponding to a pressure of about 3/10ths to 1.5 inches Hg absolute.

PULL-DOWN POINT

Evacuation is continued to an absolute pressure in the range of about 0.3 – 0.5 inches Hg absolute, indicated at point B.

At this point all, or virtually all, of the non-condensibles have been removed from the chamber, the space between the leaves in the chamber, and from within the individual tobacco leaves.

When this point is reached both the chamber and the tobacco temperature will be substantially the same, and may, for example, be in the range of from about 33° to 85° F.

FIRST STEAMING

At this point the chamber steaming valve 16 is opened, the chamber isolation valve 31 closed. The probe isolation valve 33 remains open and the condenser isolating valve 26 remains closed.

In this condition steam enters the chamber via line 15 and is pulled radially inwardly through the tobacco toward the probe, from whence unused steam and non-condensables are evacuated via lines 32, 27 and first stage steam ejector 30 to condenser 25, the second and third jets, and thence to atmosphere.

As the steam moves radially inwardly it enters the pores of the tobacco, from which non-condensibles have been earlier removed, and moistens and heats the individual pieces of tobacco.

Shortly before the upper absolute pressure limit of the first stage ejector is reached, probe isolation valve 33 is closed and condensor isolation valve 26 is opened to permit the vacuum to be controlled by the second and third stage jets.

During this portion of the cycle, which may for example extend from about the 7 minute mark to the 14 minute mark, steam is being admitted through line 15 slightly faster than it can be condensed or evacuated through probe 18 with the result that the pressure and temperature both increase until point C is reached. Point C represents a pre-determined maximum temperature which may be, for example, in the range of about 152° to 160° F. At point C the chamber temperature will be at the pre-determined maximum, but the temperature of at least portions of the tobacco will be something less than the pre-determined maximum because of the temperature lag experienced during the conditioning process.

It may, for example, be desired to terminate the pressure rise portion of the first steaming step when the pressure is in the range of about 9 – 11 inches Hg absolute, but in any event less than about 160° F, which is the temperature above which the tobacco may be deleteriously affected. Or it may, for example, be sufficient to raise the temperature only to about 140° F since experience has shown that good penetration of the tobacco occurs at this temperature and pressure and insect life is effectively killed. However the individual operator may wish to carry the temperature higher, as for example to 152° F, which for many years was thought to be the minimum temperature necessary to ensure total insect kill.

It will also be understood that shortly after the lower effective operating limit of the second and third stage steam ejectors was reached during the pressure rise, the first stage ejector was shut down.

FIRST HOLDING

When point C is reached at about 14 minutes chamber steaming valve 16 is throttled so that a balance is established between steam admitted and steam removed by the vacuum system.

The length of the first holding period may be varied within several minutes. In the illustrated cycle a period of time of about 2 minutes is shown. Preferably the total time of the first and second holding periods is about 6 minutes, and accordingly the first holding period may be shortened or lengthened as desired, at least within this range.

The primary function of the first holding period is to ensure that all portions of the tobacco reach the desired temperature which, as mentioned above, may be in the range of about 152° to about 160° F.

It will be understood that during this first holding period the steam and any non-condensibles entering the chamber via line 15 will be continually pulled radially inwardly through the tobacco and unused steam or non-condensibles discharged through evacuation probe 18.

RE-EVACUATION

At the end of the first holding period, that is, when point D in the cycle has been reached, the chamber steaming valve 16 is closed, the chamber isolation valve 31 is slowly opened, and the probe isolation valve 33 is opened while the chamber isolating valve 26 remains open.

As a result the pressure in the chamber and in the tobacco drops into the range of about 3.5 – 6.5 inches Hg absolute, which corresponds to a chamber temperature of about 120° – 140° F.

Because of the higher specific gravity of the tobacco, however, the temperature of the tobacco will lag the temperature in the chamber; a typical range of temperature for the tobacco at this time may be 130° – 145° F.

It is at this point in the cycle that a loosening action of the tobacco will occur. The loosening action is controlled by the re-evacuation rate and can be seen by visual observation through a porthole in the chamber. The volume of the mass of tobacco actually expands an inch or more in height and/or diameter.

SECOND HOLDING PERIOD

At point E on the cycle chamber isolation valve 31 and probe isolation valve 33 are closed, chamber steaming valve 16 is opened slowly, and steam is again admitted to the chamber.

Preferably the steam is admitted at the same rate it is condensed and exhausted through the vacuum system, so that the pressure remains substantially constant during the second steaming step. The condenser isolating valve 26 remains open so that creation of vacuum is under control of the second and third stage jets.

The length of the second steaming step E–F may be varied within limits. In the representative cycle a period of four minutes has been shown, although, as mentioned earlier, this may be increased or decreased. It is preferred, however, that the length of the two holding periods C–D and E–F total about 6 minutes.

In any event the holding period is long enough so that all the tobacco reaches the chamber temperature. In the illustrated example a chamber and tobacco temperature of 130° F, which corresponds to an absolute pressure of 4.5 inches Hg, has been illustrated.

BREAK-OUT AND CYCLE END

At the end of the second steaming step, point F, the chamber steaming valve 16 and the condenser isolating valve 26 are closed (chamber isolating valve 31 and probe isolation valve 33 remain closed) and vacuum break valve 14 is opened to admit atmospheric pressure to the interior of the chamber.

Preferably the break vacuum valve 14 is opened slowly so that pressure equalizes gradually inside and outside the tobacco.

At the end of the cycle the temperature in the chamber will of course rise to ambient and the pressure to 29.92 inches Hg absolute. The temperature of the tobacco will remain at the last holding temperature, in this instance preferably about 130° F ± 20. At this temperature, however, it is suitable for further processing.

REMOVAL

The probe control mechanism 20 is then operated to retract probe 18 and the tobacco is removed from the chamber and transferred to the next processing station. The vacuum break valve 14 is then closed and the chamber is in condition to receive another load of tobacco to be processed.

At the conclusion of the process, which required only about 23 minutes for a conventional sized hogshead, the tobacco is in a loosened condition with no cold spots.

For further amplification of the temperatures and pressures which may exist in the system during a typical cycle, refer to the following Table.

TEMPERATURE/PRESSURE CONDITION TABLE

| Step | Point In Cycle | Temperature, °F Chamber | Tobacco | Pressure, in. Hg. abs. |
|---|---|---|---|---|
| Initial Evacuation | A | Ambient | 33°–95° | 30 |
| Flash Point | $A_1$ | 33°–95° | 33°–95° | .3–1.5 |

-continued

TEMPERATURE/PRESSURE CONDITION TABLE

| Step | Point In Cycle | Temperature, °F Chamber | Tobacco | Pressure, in. Hg. abs. |
|---|---|---|---|---|
| Pull Down Point | B | 33° | 33°–85° | .2 |
| First Holding | C | 160° | less than 160° | 10.0 |
| Re-Evacuation | D | 160° | 152°–160° | 10.0 |
| Second Holding | E | 120°–140° | 130°–145° | 3.5–6.5 |
| | | 130° | 130°–140° | 4.5 |
| Break-Out | F | 130° | 130° ± 2° | 4.5 |
| Cycle End | G | Ambient | 130° ± 2° | 30 |

One of the desirable attributes of the invention is that non-condensibles are almost totally removed from the tobacco leaf prior to initial admission of steam. This facilitates steam penetration into the individual tobacco leaves during the initial steaming. Experience has shown that the penetration of the steam into the tobacco leaf during the second steaming is substantially superior to second time penetration in other processes, and this uniformity and ease of penetration is believed to be attributable, at least in substantial part, to the substantially complete removal of non-condensibles prior to the first steaming step. It will be understood, of course, that steam itself carries non-condensibles, the elimination of which is not possible; however, by removing a maximum amount of non-condensibles prior to the initial steaming, a maximum amount of steam is admitted to the tobacco leaves.

Further, the steaming is especially efficient because a maximum driving force has been provided for adding steam to the individual tobacco leaves. That is, the absolute pressure is in the neighborhood of 0.3 – 0.5 inches Hg absolute at the start of the initial steaming step, and the pressure may rise to as high as 9 – 10 inches Hg absolute. This should be contrasted with other cycles, such as the Vacuum Flow cycle in which the pressure differential may only be on the order of about 4 inches Hg absolute.

It will at once be apparent to those skilled in the art that other modifications may be made within the spirit and scope of the invention. Accordingly, it is intended that the scope of the invention be limited not by the scope of the foregoing description, but solely by the scope of the hereafter appended claims when interpreted in light of the pertinent prior art.

I claim:

1. Apparatus for moistening tobacco, said apparatus including, in combination, a gas-tight chamber of a size large enough to receive a mass of tobacco to be moistened, an evacuation probe associated with the chamber and movable from a retracted position in which it is out of contact with the mass of tobacco to be moistened in the chamber to an extended position in which it penetrates said mass of tobacco, said probe being connected to first vacuum means, said first vacuum means being effective to lower the absolute pressure in said chamber from atmospheric down to about, but not substantially less than 1 inch Hg absolute, but, in any event, to an absolute pressure greater than the flash point of the tobacco being moistened, second vacuum means, said second vacuum means including a steam ejector and condensing means therefore and being effective to lower the absolute pressure in the chamber from a maximum of about 2–3 inches Hg absolute down to an absolute pressure of about 0.2 inch Hg absolute, but, in any event, to an absolute pressure less than the flash point of the tobacco being moistened, first valve and conduit means operable, during an initial evacuation, to connect the chamber to said first vacuum means and to at least partially by pass connection of said chamber to said second vacuum means, second valve and conduit means, operable after the aforesaid maximum absolute pressure of about 2–3 inches Hg absolute is reached, to connect said second vacuum means and said first vacuum means to said chamber wherein tobacco within said chamber is subjected to the combined effects of the first and second vacuum means, and thereby said tobacco is subjected to an absolute pressure below its flash point, means for thereafter admitting steam to the chamber while evacuating only through said probe at a rate which causes the absolute pressure in the chamber to increase from a level less than the flash point of the tobacco to a maximum upper level which corresponds to the temperature at which the tobacco can be deleteriously affected by the temperature which corresponds thereto, said second valve and conduit means being operable to disconnect said second vacuum means from said evacuation system prior to the aforesaid maximum absolute pressure thereof is reached, and after attachment of the minimum effective absolute pressure of the first vacuum means is reached, means for thereafter subjecting said tobacco to a substantially constant pressure while simultaneously steaming into the chamber while evacuating only through the probe, means for thereafter lowering the absolute pressure to which the tobacco is subjected to a level within the capacity of the first vacuum means by evacuating solely through the probe, and means for thereafter controllably increasing the absolute pressure to which the tobacco is subjected to atmospheric.

2. The apparatus of claim 1 further characterized in that said (1) first valve and conduit means, (2) second valve and conduit means, (3) means for admitting steam to the chamber while evacuating only through said probe, and (4) means for disconnecting the second vacuum means from the evacuation system, consists of three valves in two conduit lines, which conduit lines are connected, at their first terminals, to the chamber and the probe respectively, and, at their second ends, to the second vacuum means and the condenser means respectively.

3. The apparatus of claim 2 further characterized by and including a cooling tower and a condensate recirculating system associated therewith.

* * * * *

UNITED STATES PATENT AND TRADEMARK OFFICE

CERTIFICATE OF CORRECTION

PATENT NO. : 4,008,724

DATED : February 22, 1977

INVENTOR(S) : Leonard T. DeCoursey

It is certified that error appears in the above-identified patent and that said Letters Patent are hereby corrected as shown below:

On the title page add:

(73) Assignee: John Mohr & Sons, Chicago, Ill.

Signed and Sealed this

*Thirty-first* Day of *May 1983*

[SEAL]

*Attest:*

DONALD J. QUIGG

*Attesting Officer*

*Acting Commissioner of Patents and Trademarks*